United States Patent [19]

Rutledge

[11] Patent Number: 4,928,450

[45] Date of Patent: May 29, 1990

[54] PANEL SYSTEM FOR WINDOWS

[76] Inventor: F. Wayne Rutledge, 716 Acadia Drive Southeast, Calgary, Alberta, Canada, T2J 0C3

[21] Appl. No.: 238,179

[22] Filed: Aug. 30, 1988

[51] Int. Cl.[5] ..... E06B 3/26

[52] U.S. Cl. ..... 52/202; 52/203; 49/128

[58] Field of Search ..... 52/202, 203, 204; 49/125, 127, 128, 130

[56] References Cited

U.S. PATENT DOCUMENTS

| | | | |
|---|---|---|---|
| 556,759 | 3/1896 | Lenz et al. | 49/128 |
| 3,693,694 | 9/1972 | Elhen | 49/127 X |
| 3,816,964 | 6/1974 | Catalano | 49/127 |
| 4,677,797 | 7/1987 | Roth | 52/204 X |

*Primary Examiner*—David A. Scherbel
*Assistant Examiner*—Creighton Smith
*Attorney, Agent, or Firm*—George H. Dunsmuir

[57] ABSTRACT

Devices for covering the interior of windows include venetian blinds, shades, drapes, curtains and shutters. A simple decorative alternative to such devices is a system including a rectangular frame for mounting in or on a window frame, the rectangular frame containing partitions extending between the top and bottom or sides of the frame, both sides of the partitions and the inner sides of the top and bottom or sides of the frame containing recesses defining longitudinally and transversely extending tracks, in which are mounted a plurality of discrete panels. The panels can be slid longitudinally and transversely of the frame independently of each other for blocking selected portions of the window opening.

10 Claims, 2 Drawing Sheets

PANEL SYSTEM FOR WINDOWS

BACKGROUND TO THE INVENTION

This invention relates to a panel system, and in particular to a panel system for windows.

There are a large number of devices currently available for covering the interior of windows, including venetian blinds, shades, drapes, curtains and shutters. While such devices perform their intended purpose, there is always room for variation, i.e. for different types of window coverings.

The object of the present invention is to provide a simple, decorative panel system for use on windows which has a relatively high degree of versatility.

BRIEF SUMMARY OF THE INVENTION

Accordingly, the present invention relates to a panel system for windows comprising a pair of track means for mounting on a window frame in parallel relationship to each other; longitudinally and transversely extending slot means in opposing, parallel surfaces of said track means; and a plurality of discrete panel means for slidable mounting in said slot means, whereby each of said panel means can be independently moved lonqitudinally and transversely with respect to said track means to block selected portions of the window opening.

BRIEF DESCRIPTION OF THE DRAWINGS

The invention will be described in detail with reference to the accompanying drawings, which illustrate a preferred embodiment of the invention, and wherein:

With reference to FIG. 1, the panel system of the present invention is intended for use with a window generally indicated at 1 of the type including a rectangular frame 2 and a pane of glass 3. Of course, the panel system can be used in an internal window well, the frame of which is defined by drywall or the like. The system can also be used with multi-pane windows.

The panel system includes a frame generally indicated at 5 for mounting on or in the window frame 2, and a plurality of discrete panels generally indicated at 6. The frame 5 is defined by a top wall 8, a bottom wall 9, end walls 10, and vertical partitions 12. The top and bottom walls 8 and 9 are defined by straight, planar boards. Referring to FIG. 2, the inner surface 14 of each end wall 10 defines a track for receiving panels 6. The track is defined by a plurality of square recesses 15 extending the entire length of the inner surface 14 of each end wall 10. The recesses 15 alternate with projections 17. A plurality of spaced apart, horizontal recesses 18 are provided in the inner surface 14 of each end wall 10. As described hereinafter in greater detail, the top edges 20 of the projections 17 bordering the recesses 18 define stops. Similar recesses 15 and 18, and projections 17 are provided in both sides of each of the partitions 12.

Figures 1, 3:
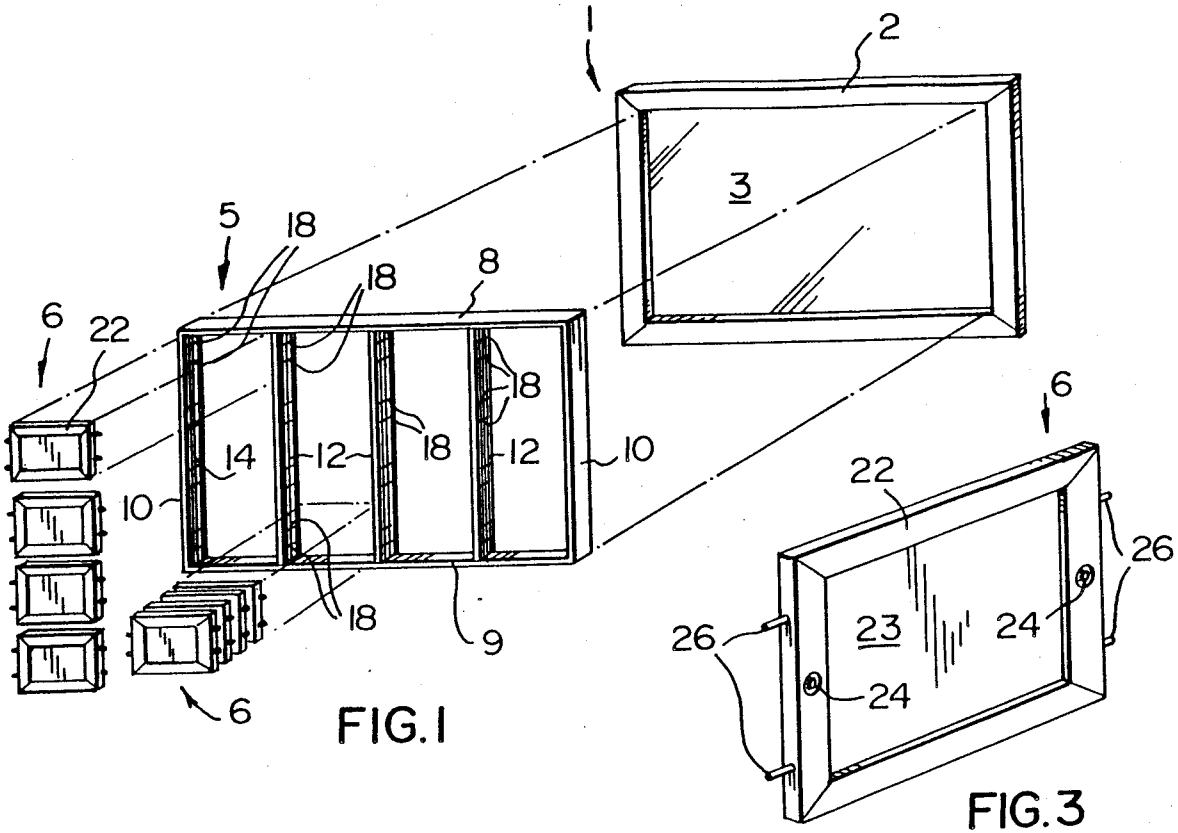
FIG. 1 is an exploded, perspective view of a window and panel system in accordance with the present invention.
FIG. 3, which appears on the first sheet of drawings with FIG. 1, is a perspective view from above and one end of a panel used in the system of FIG. 1.
Figure 2:
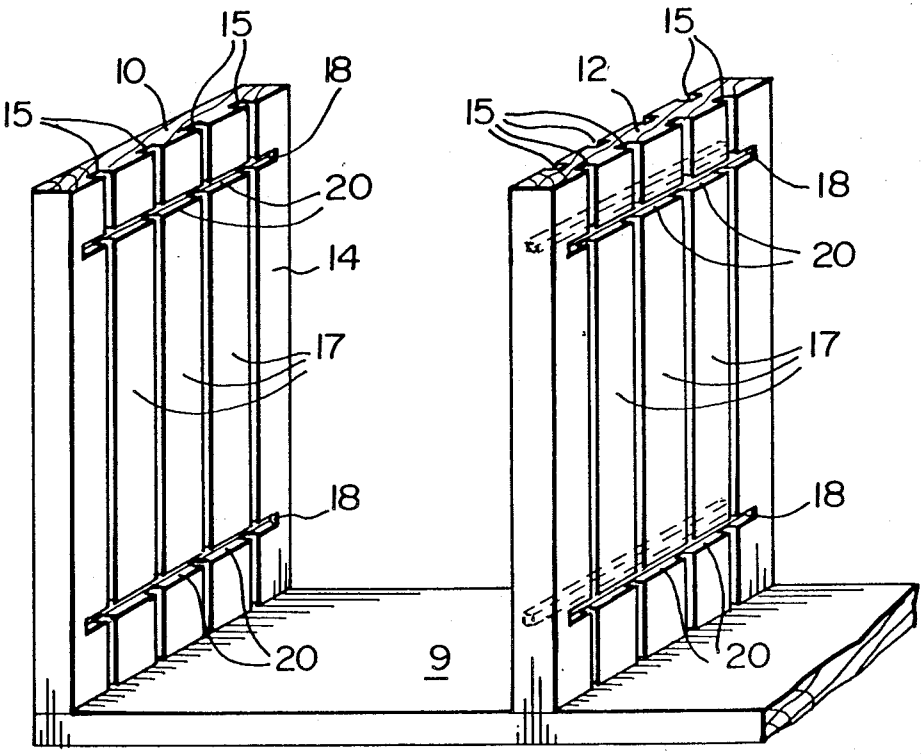
FIG. 2 is a perspective view of one bottom corner of a frame used in system of FIG. 1.

As best shown in FIG. 3, each panel 6 is defined by a rectangular frame 22 holding a central panel or plate 23. Recessed knobs 24 are provided in the front surface of each end of the frame 22 facilitating movement of the panel 6 in the frame 5. A pair of spaced apart pins 26 extend outwardly from each end of the frame 22. The pins 26 are spaced apart by the same distance as the longitudinal centre lines of adjacent horizontal recesses 18 in the end walls 10 and in the partitions 12.

It will be readily apparent that four panels 6 are mounted between each end wall 10 and each adjacent partition 12. The panels 6 can be aligned horizontally so that only one quarter of the opening between adjacent partitions 12 or between adjacent end walls and partitions is blocked. Alternatively, the individual panels 6 can be moved transversely in the slots 18, and then longitudinally to block one-half, three quarters or the full opening between adjacent end walls and partitions. In the rest position, the pins 26 normally rest on the stops defined by the edges 20 of the projections 17 bordering the recesses 18, or in recesses 15, in which case the panels 6 are aligned vertically and supported by the bottom wall 9.

It will be appreciated that the plates 23 defining the centres of the panels 6 can be semi-transparent or opaque. The panels can be colored or carry a variety of designs. The panels can be formed of wood, plastic, glass or fabric, and can be louvered or solid. Obviously, the top and bottom walls of the frame 5 can define tracks, with the partitions 12 extending horizontally, i.e. the frame openings can be elongated in the horizontal sense for horizontal panel movement.

What is claimed is:

1. In combination, a window having a window frame, and an accessory light-controlling panel system comprising a pair of first track means mounted adjacent the window frame in parallel relationship with the window and frame; longitudinally and transversely extending slot means in opposing, parallel surfaces of said first track means; and a plurality of discrete light-controlling panel means for slidable mounting in said slot means, whereby each said panel means can be independently moved longitudinally and transversely with respect to said first track means to block selected portions of the window opening.

2. The combination according to claim 1, including end wall means interconnecting the ends of said first track means to define frame means adjacent the window frame.

3. The combination according to claim 1, including partition means mounted between and parallel to said first track means, and second track means on each side of said partition means for slidably receiving light-controlling panel means with said first track means, whereby said panel means can be slidably mounted in parallel rows.

4. The combination according to claim 3, including end wall means interconnecting the ends of said first and second track means and said partition means to define frame means mounted adjacent the window frame.

5. The combination according to claim 1, wherein each said panel means includes a frame; a light-controlling panel mounted in said frame; and fixed pin means extending outwardly from opposite, parallel sides of said frame for sliding in said track means.

6. In combination, a window having a window frame, and an accessory light-controlling panel system comprising frame means mounted at least adjacent the window frame to overlie at least a substantial portion of the window, said frame means including bottom wall means, top wall means, side wall means and slot means in opposing surfaces of each of at least two opposing first wall means; and a plurality of discrete light-controlling panel means for slidable mounting in said slot means, whereby each said panel means can be moved independently, longitudinally and transversely with respect to said frame means to block selected portions of the area within said frame means.

7. The combination according to claim 6, wherein said frame means includes partition means extending between the remaining two opposing wall means; and slot means in each side of said partition means, whereby panel means can be slidably mounted between each said first wall means and said partition means.

8. The combination according to claim 7, wherein said panel means includes a frame; a light-controlling panel mounted in said frame; and fixed pin means extending outwardly from opposite sides of said frame for sliding in said slot means.

9. The combination according to claim 8, wherein said slot means are located in each said side wall means, and said partition means extends between said top wall means and said bottom wall means, whereby said panel means can slide vertically and horizontally in a direction transversely of said side wall means and partition means.

10. The combination according to claim 9, wherein said slot means include a plurality of discrete parallel vertical slots; vertical stops separating said vertical slots; and horizontal slots intersecting said vertical stop, whereby said pin means extend into said slots for vertical and transverse movement, and rest on said stops when in a fixed position, and said panel means can form a vertical wall resting on the bottom wall means of said frame means with said pin means extending into said vertical slots.

* * * * *